US010525574B2

(12) United States Patent
Sekiguchi et al.

(10) Patent No.: US 10,525,574 B2
(45) Date of Patent: Jan. 7, 2020

(54) DRIVING TOOL

(71) Applicant: MAX CO., LTD., Chuo-ku, Tokyo (JP)

(72) Inventors: Norimichi Sekiguchi, Tokyo (JP); Hiroshi Tanaka, Tokyo (JP); Michiaki Adachi, Tokyo (JP); Takeshi Shiraishi, Tokyo (JP)

(73) Assignee: MAX CO., LTD., Tokyo (JP)

( * ) Notice: Subject to any disclaimer, the term of this patent is extended or adjusted under 35 U.S.C. 154(b) by 500 days.

(21) Appl. No.: 15/244,143

(22) Filed: Aug. 23, 2016

(65) Prior Publication Data

US 2017/0057069 A1 Mar. 2, 2017

(30) Foreign Application Priority Data

Aug. 24, 2015 (JP) ..... 2015-165109

(51) Int. Cl.
*B25C 1/04* (2006.01)

(52) U.S. Cl.
CPC ..... *B25C 1/042* (2013.01)

(58) Field of Classification Search
CPC ..... B25C 1/04; B25C 1/041; B25C 1/042
USPC ..... 227/9, 10, 90, 107–156
See application file for complete search history.

(56) References Cited

U.S. PATENT DOCUMENTS 5,131,579 A * 7/1992 Okushima ..... B25C 1/008 173/210
5,207,143 A * 5/1993 Monacelli ..... B25C 1/042 227/130
5,476,205 A * 12/1995 Canlas ..... B25C 1/042 227/130
5,645,208 A * 7/1997 Haytayan ..... B25C 1/008 227/130
5,878,936 A * 3/1999 Adachi ..... B25C 1/041 227/130
7,475,800 B2 * 1/2009 Liang ..... B25C 1/043 227/129
7,490,748 B2 * 2/2009 Komazaki ..... B25C 1/044 227/130
8,016,046 B2 * 9/2011 Zhao ..... B25C 1/08 173/1

(Continued)

FOREIGN PATENT DOCUMENTS

CN 100439042 C 12/2008
DE A1-2422223 11/1975

(Continued)

OTHER PUBLICATIONS

Extended European Search Report dated Feb. 27, 2017 in corresponding European patent application 16001846.1 (8 pages).

*Primary Examiner* — Gloria R Weeks
*Assistant Examiner* — Dariush Seif
(74) *Attorney, Agent, or Firm* — Rothwell, Figg, Ernst & Manbeck, P.C.

(57) ABSTRACT

A driving tool including a driver configured to drive out a fastener, a piston to which the driver is connected, a cylinder in which the piston is disposed so as to be reciprocated, a head valve which is slidably mounted to an outer circumferential side of the cylinder and controls a flow of compressed air into the cylinder, and a seal portion which is provided to face an opening edge of the head valve. The seal portion includes a lip portion protruding along an outer circumferential surface of the head valve.

16 Claims, 8 Drawing Sheets

(56) References Cited

U.S. PATENT DOCUMENTS 8,162,195 B2 * 4/2012 Wu ..... B25C 1/047 227/130
9,662,777 B2 * 5/2017 Pomeroy ..... B25C 1/041
9,676,090 B2 * 6/2017 Moore ..... H02K 35/02
2008/0006670 A1 * 1/2008 Wen ..... B25C 1/045 227/130
2008/0023519 A1 * 1/2008 Aihara ..... B25C 1/042 227/130
2008/0217372 A1 * 9/2008 Webb ..... B25C 1/08 227/10
2009/0230166 A1 * 9/2009 Yamamoto ..... B25C 1/042 227/130
2010/0327040 A1 * 12/2010 Aihara ..... B25C 1/047 227/130
2011/0114692 A1 * 5/2011 Liang ..... B25C 1/04 227/2
2011/0198384 A1 * 8/2011 Kitagawa ..... B25C 1/008 227/130
2011/0290850 A1 * 12/2011 Wu ..... B25C 1/04 227/130
2012/0067935 A1 * 3/2012 Liu ..... B25C 1/047 227/10
2012/0074194 A1 * 3/2012 Miller ..... B25C 1/008 227/8
2012/0097730 A1 * 4/2012 Liang ..... B25C 1/044 227/130
2012/0318841 A1 * 12/2012 Liu ..... B25C 1/047 227/130
2014/0158740 A1 * 6/2014 Akutsu ..... B25C 1/044 227/130

FOREIGN PATENT DOCUMENTS

JP 2006-055939 A 3/2006
JP 2008-068344 A 3/2008
JP 2010-023177 A 2/2010
JP 4706604 B2 6/2011
JP 2015-098068 A 5/2015
TW 200300379 A 6/2003
WO WO-A1-2008/149902 12/2008

* cited by examiner

DRIVING TOOL

CROSS-REFERENCE TO RELATED APPLICATION

This application claims priorities from Japanese Patent Application No. 2015-165109 filed on Aug. 24, 2015, the entire contents of which are incorporated herein by reference.

FIELD

The present disclosure relates to a driving tool which operates a piston by compressed air to drive out a fastener, and particularly to a driving tool which prevents air leakage of a head valve.

BACKGROUND

As such a kind of driving tool, there is known a tool including a head valve which controls a flow of compressed air into a cylinder. When a trigger of the driving tool is manipulated, the head valve is operated to open a supply passage into the cylinder. Accordingly, the compressed air flows into the cylinder to operate a piston, and thus a fastener is driven. At this time, an exhaust passage communicating with the inside of the cylinder is closed by the head valve. When the driving is completed, and the head valve returns to an initial position, the supply passage into the cylinder is closed, and the exhaust passage communicating with the inside of the cylinder is opened to discharge the compressed air in the cylinder.

In such a structure, it is ideal that the exhaust passage communicating with the inside of the cylinder is closed at the same time when the supply passage into the cylinder is opened. However, it is difficult to perform the operation in a strictly simultaneous manner due to the problem such as dimension management. Therefore, in practice, a structure is adopted in which the exhaust passage is closed after the supply passage is opened or the supply passage is opened after the exhaust passage is closed.

However, in the structure that exhaust passage is closed after the supply passage is opened, there is a timing when the supply passage and the exhaust passage are not sealed, and thus a problem occurs in which the compressed air supplied from the supply passage leaks from the exhaust passage, and an air consumption amount is increased.

On the other hand, in the structure that the supply passage is opened after the exhaust passage is closed, a slide resistance in a seal portion is increased, and thus a problem occurs in which the response of the head valve is delayed to cause an energy loss or a discharge delay.

In Japanese Patent Publication (JP-B) No. 4706604 as a technology relating thereto, the description is given about a technology having a structure that the leg portion extending from the outer circumference of the head bumper has a ring-shaped seal member extending toward the main valve (head valve), and the seal member performs sealing by contacting the inner wall surface of the main valve.

According to such a technology, in the structure that the exhaust passage is closed after the supply passage is opened, the seal member extending toward the head valve is provided so that the timing when the supply passage is opened can be set close to the timing when the exhaust passage is closed and the leakage of the compressed air into the exhaust passage can be suppressed.

In the technology described in JP-B-4706604, however, sealing is performed by contacting the rubber seal portion with the inner wall surface of the head valve, and thus a problem occurs in which it is necessary to severely manage a dimension. That is, there is a concern that the rubber is changed in a dimension by an error in production or a temperature change. When the dimension is changed, a problem occurs in which the slide resistance with the head valve is increased to affect an operation, or conversely, the seal portion is apart from the head valve so that it becomes difficult to secure airtightness.

In this regard, an object of the disclosure is to provide a driving tool, of which a structure that the exhaust passage is closed after the supply passage into a cylinder is opened, and in which it is suppressed that compressed air leaks from an exhaust passage after a supply passage is opened and it is not necessary to severely manage a dimension in producing.

SUMMARY

The disclosure has been made to resolve the above-described problem, and has the following features.

An aspect of the disclosure is to provide a driving tool including:

a driver configured to drive out a fastener;

a piston to which the driver is connected;

a cylinder in which the piston is disposed so as to be reciprocated;

a head valve which is slidably mounted to an outer circumferential side of the cylinder and controls a flow of compressed air into the cylinder; and a seal portion which is provided to face an opening edge of the head valve.

wherein the seal portion includes a lip portion protruding along an outer circumferential surface of the head valve.

The lip portion may protrude with a clearance provided between the lip portion and the outer circumferential surface of the head valve.

When the head valve slides in a direction of being apart from the seal portion, an air pressure difference may be generated between an inside and an outside of the lip portion, and the lip portion may be bent in a direction of contacting the outer circumferential surface of the head valve.

A tapered surface may be formed on an inner circumferential side of a tip of the lip portion or an outer circumferential side of an opening edge of the head valve.

A seal member may be mounted to any one of the head valve and the cylinder, a receiving portion facing the seal member may be provided in the other one of the head valve and the cylinder, the receiving portion may include a seal surface formed obliquely to a sliding direction of the head valve, and an exhaust passage formed between the cylinder and the head valve may be sealed by the seal member contacting with the seal surface.

According to the driving tool of the aspect of the disclosure as described above, the seal portion is provided to face the opening edge of the head valve, and the seal portion includes the lip portion protruding along the outer circumferential surface of the head valve. With such a configuration, in the structure in which the exhaust passage is closed after the supply passage is opened, the timing when the supply passage is opened can be set close to the timing when the exhaust passage is closed, and thus the leakage of the compressed air to the exhaust passage can be suppressed.

According to the driving tool of the disclosure as described above, the lip portion protrudes with the clearance provided between the lip portion and the outer circumferential surface of the head valve. With such a configuration, the clearance is provided in advance between the lip portion and the outer circumferential surface of the head valve, and thus a slide resistance with the head valve does not increase although there is a slight dimension change in the seal portion. That is, the slide resistance does not increase although the dimension is not severely managed.

According to the driving tool of the disclosure as described above, when the head valve slides in the direction of separating from the seal portion, the air pressure difference is generated between the inside and the outside of the lip portion, and the lip portion is bent in the direction of contacting the outer circumferential surface of the head valve. That is, the lip portion protrudes along the outer circumferential surface of the head valve, and thus in starting the movement of the head valve, the lip portion is deformed by the air pressure difference, and contacts the head valve. For this reason, the lip portion seals the supply passage although the clearance is provided, and thus the timing when the supply passage is completely opened can be delayed. The time difference between the timing when the supply passage is opened and the timing when the exhaust passage is closed is shortened by delaying the timing when the supply passage is completely opened, and thus the leakage of the compressed air from the exhaust passage can be suppressed.

According to the driving tool of the disclosure as described above, the tapered surface is formed on the inner circumferential side of the tip of the lip portion or the outer circumferential side of the opening edge of the head valve. Thus the operation can be smoothly performed while the lip portion and the head valve are not caught.

According to the driving tool of the disclosure as described above, the seal member is mounted in any one of the head valve and the cylinder, the receiving portion facing the seal member is provided in the other one the head valve and the cylinder, and the receiving portion includes the seal surface formed obliquely to the sliding direction of the head valve. The exhaust passage formed between the cylinder and the head valve is sealed by contacting the seal member with the seal surface. With such a configuration, until the seal member contacts the receiving portion, the seal member does not almost contact another member. Therefore, it can be prevented that the seal member increases the slide resistance of the head valve, and the head valve can be smoothly slid. The head valve is smoothly slid so that the time until the exhaust passage is sealed is shortened, and thus the time difference between the timing when the supply passage is opened and the timing when the exhaust passage is closed is shortened so that the leakage of the compressed air from the exhaust passage can be suppressed.

DETAILED DESCRIPTION

An embodiment of the invention will be described with reference to the drawings.

Figure 1:
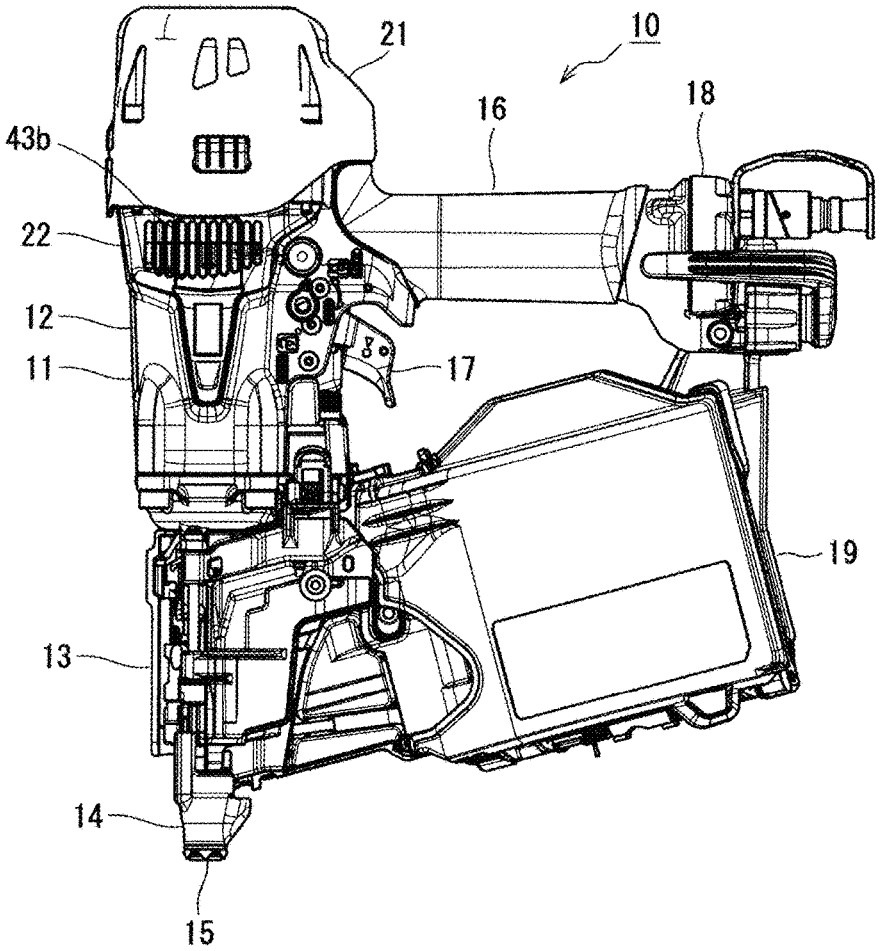
FIG. 1 is a side view illustrating a driving tool.

A driving tool 10 according to this embodiment is a pneumatic driving tool 10 which drives a fastener using compressed air. As illustrated in FIG. 1, the driving tool includes a tool main body 11 having a nose portion 13 and a magazine 19 connected to the tool main body 11. A connection fastener is contained in the magazine 19, and the connection fastener is pulled out in a direction of the nose portion 13 and used for driving.

Figure 2:
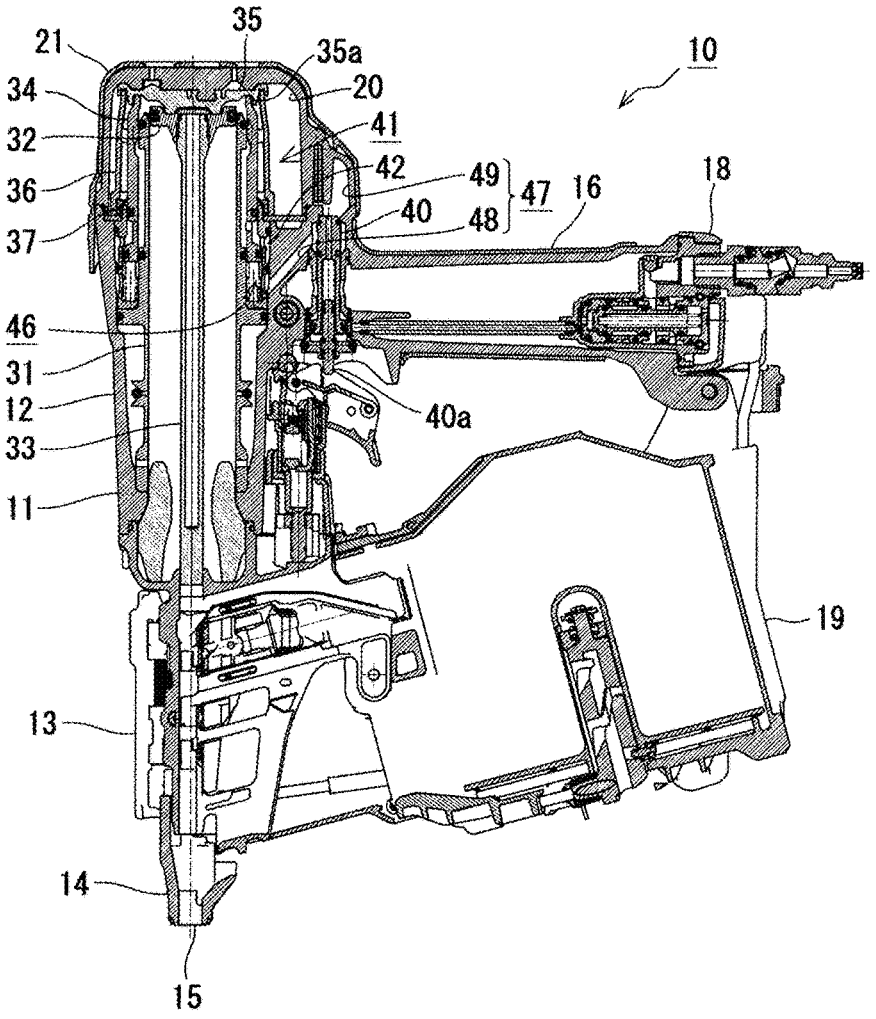
FIG. 2 is a sectional view illustrating the driving tool.

As illustrated in FIGS. 1 and 2, the tool main body 11 includes a body housing 12, a grip housing 16 connected to the body housing 12 at a substantially perpendicular angle, the nose portion 13 integrally fixed to the front end side (a driving direction of the fastener) of the body housing 12, and a cap housing 20 integrally fixed to the rear end side (an opposite direction to the driving direction of the fastener) of the body housing 12.

As illustrated in FIG. 2, a cylinder 31 is disposed inside the body housing 12 and the cap housing 20, and a piston 32 is contained in the cylinder 31 so as to be reciprocated. A driver 33 for striking the fastener is coupled with the lower surface of the piston 32. When the piston 32 is operated by the pneumatic pressure of the compressed air, the driver 33 is moved downward integrally with the piston 32 to drive the fastener. The compressed air for operating the piston 32 is supplied from an external device such as an air compressor. Such an external device is connected to an end cap portion 18 provided in a rear end of the grip housing 16. The compressed air supplied from the external device can pass into the grip housing 16 and be supplied to the cylinder 31.

The nose portion 13 is provided to inject the fastener, and the above-described driver 33 is guided to be slidable in the direction of the nose portion 13. A fastener supply mechanism is provided on the rear side of the nose portion 13. The feeding operation of the fastener supply mechanism is executed in conjunction with the driving operation. The fastener contained in the magazine 19 is fed to the nose portion 13 through the feeding operation.

A contact portion 14 pushed against a target material to be driven is mounted in the tip of the nose portion 13 so as to be slidable on the nose portion 13. The contact portion 14 is slid upward on the nose portion 13 when pushed against the target material to be driven, and such a slide of the contact portion 14 causes a safety mechanism of the driving operation to operate. While not describing the well-known safety mechanism in detail, the operation of the safety mechanism enables to manipulate a trigger 17 provided with the grip housing 16 and to drive the fastener.

When the trigger 17 is manipulated in a state where the contact portion 14 is pushed against the target material to be driven (otherwise, when the contact portion 14 is pushed against the target material to be driven in a state where the trigger 17 is manipulated), the compressed air supplied from the external device flows into the cylinder 31, and the compressed air acts on the piston 32 to run the piston 32. The piston 32 runs so that the driver 33 coupled to the piston 32 strikes a first fastener, and the fastener is driven out.

An injection port 15 through which the fastener is driven out is formed at the tip of the contact portion 14, and the inner circumferential surface of the contact portion 14 until the injection port 15 forms an injection passage of the fastener. When the fastener is driven out, the driver 33 and the fastener are guided with a stable posture by the inner circumferential surface of the contact portion 14.

The configuration of the above-described driving operation will be described further in detail.

Figure 3:
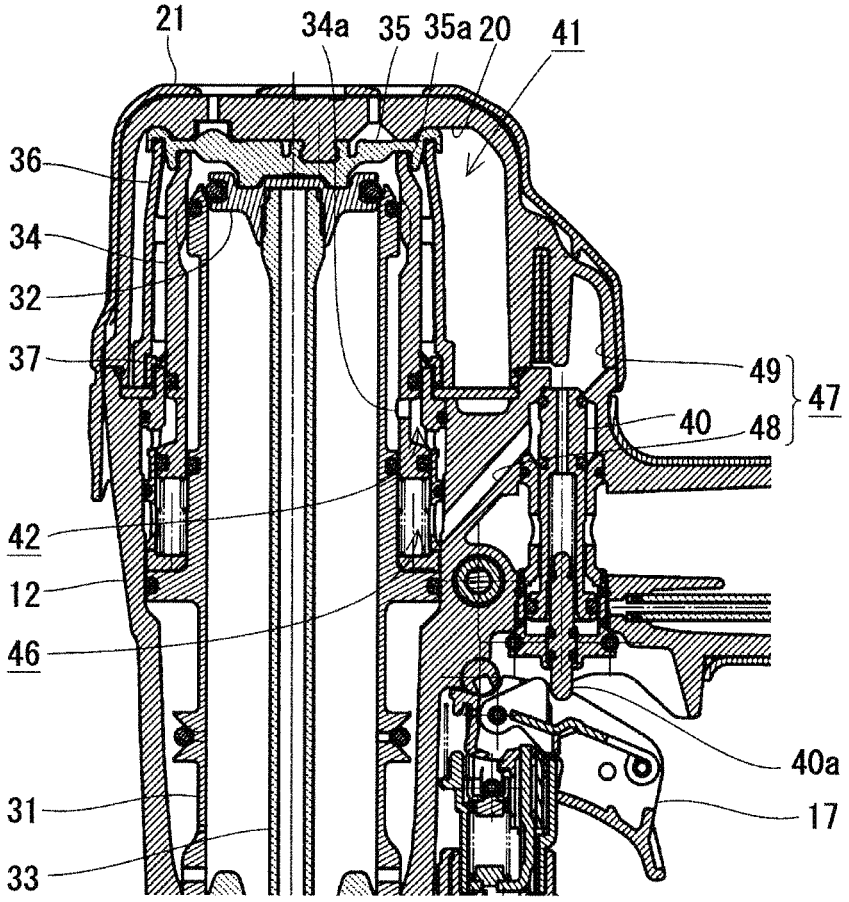
FIG. 3 is an enlarged sectional view illustrating the driving tool in a state where a trigger is set off.

As illustrated in FIG. 3, the driving tool 10 according to this embodiment inwardly includes a head valve 34 which controls the flow of the compressed air into the cylinder 31, a piston stop 35 which stops the piston 32 at a top dead point, a cylindrical guide 36 which supports the circumferential edge of the piston stop 35, a sweeper member 37 which is fixed by the cylindrical guide 36, a main chamber 41 which stores the compressed air for biasing the piston 32, a main exhaust passage 42 configured to discharges the compressed air flowing into the cylinder 31 to the outside, a head valve chamber 46 which stores the compressed air for biasing the head valve 34, a sub exhaust passage 47 configured to discharge the compressed air stored in the head valve chamber 46 to the outside, and a pilot valve 40 configured to open and close the head valve chamber 46 to an atmosphere side.

The head valve 34 is a cylindrical member disposed on the outside of the cylinder 31, and is slidable in an axial direction to the cylinder 31. As illustrated in FIG. 3, the head valve 34 is pushed upward by the compressed air stored in the head valve chamber 46 and a compression spring in a state where the pilot valve 40 is not operated (in a state where the trigger 17 is not manipulated). At this time, the force of pushing downward by the compressed air of the main chamber 41 acts on the head valve 34. However, since an area where the compressed air acts on the head valve chamber 46 side is larger than that on the main chamber 41 side, the head valve 34 is pushed upward by the differential pressure. The upper end edge of the head valve 34 pushed upward abuts against a seal portion 35*a* provided in the piston stop 35 so that the circumference of the cylinder 31 is sealed. Accordingly, the compressed air of the main chamber 41 does not flow into the cylinder 31 by the sealing.

Figure 4:
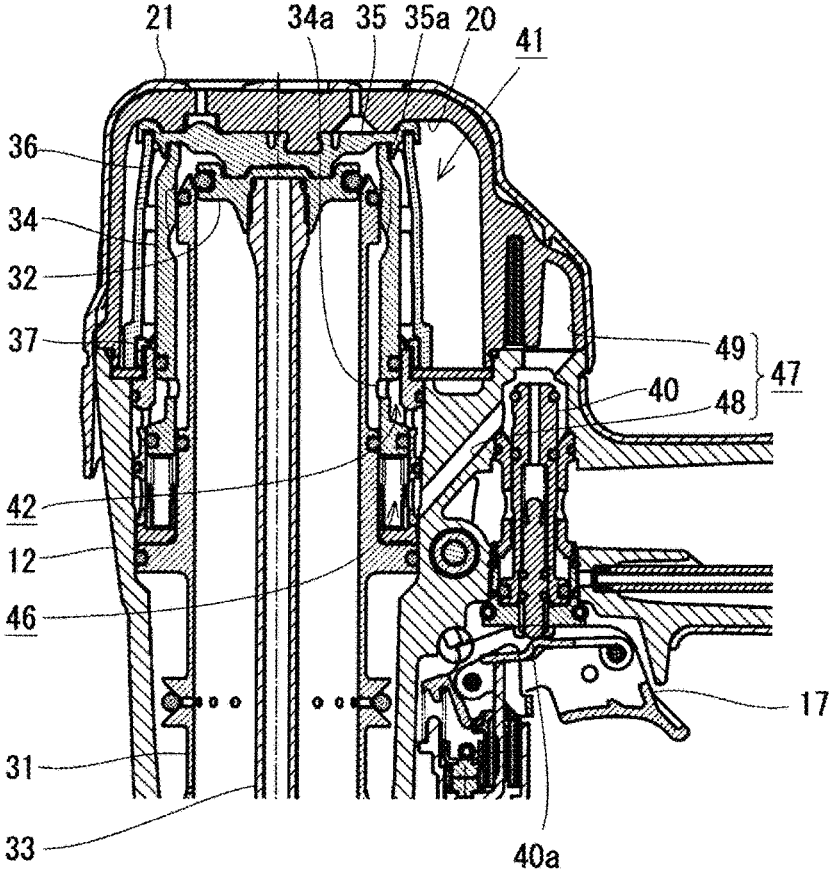
FIG. 4 is an enlarged sectional view illustrating the driving tool in a state where the trigger is set on, FIG. 5 is an enlarged sectional view illustrating the driving tool in a state where a head valve is operated.
Figure 5:
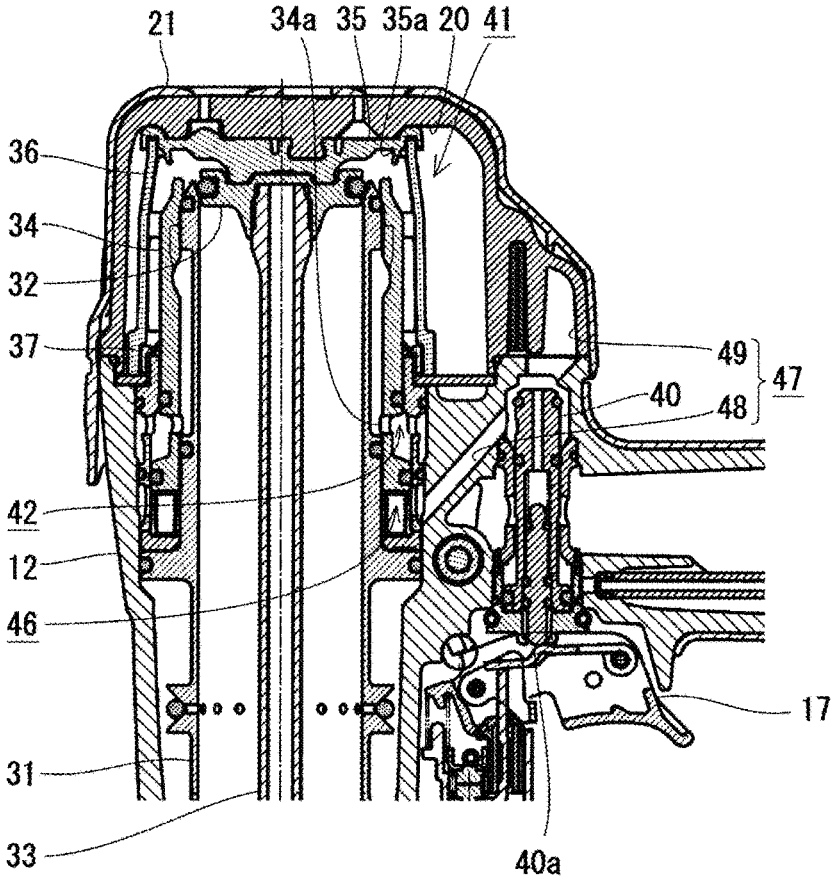

On the other hand, as illustrated in FIG. 4, when the sub exhaust passage 47 is opened in a state where the pilot valve 40 is operated, the compressed air stored in the head valve chamber 46 is discharged to the outside, and the compressed air pushing the head valve 34 upward is discharged to the outside. For this reason, as illustrated in FIG. 5, the head valve 34 is pushed downward by the compressed air of the main chamber 41. When the head valve 34 is moved downward to operate, the sealed state between the head valve 34 and the seal portion 35*a* is released so that the compressed air of the main chamber 41 flows into the cylinder 31 to run the piston 32.

The piston stop 35 is configured to receive and stop the piston 32 moved to the top dead point, and is fixed on a ceiling portion of the cap housing 20. The piston stop 35 is formed, for example, of an elastic material such as rubber in order to receive an impact of the piston 32. The seal portion 35*a* configured to seal the circumference of the cylinder 31 by being coupled with the head valve 34 is formed in the vicinity of the outer circumferential edge of the piston stop 35.

The cylindrical guide 36 is a member for supporting the vicinity of the outer circumferential edge of the piston stop 35, and supports the substantially outer circumferential side of the seal portion 35*a* to prevent the piston stop 35 from being hung down. The cylindrical guide 36 is not intended for the sealing of the compressed air, and thus a plurality of vent holes are drilled in the outer circumference thereof.

The sweeper member 37 is a ring-shaped member fixed so as to face the circumferential surface of the head valve 34. When the head valve 34 is slid, the sweeper member 37 acts to rub the circumferential surface of the head valve 34, and thus ice and the like attached to the surface of the head valve 34 is scraped off.

The main chamber 41 is a space configured to store the compressed air supplied from the external device such as the compressor. The main chamber 41 always receives the compressed air from the external device connected to the end cap portion 18.

The main exhaust passage 42 discharges the compressed air in the cylinder 31 to the outside. In this embodiment, the main exhaust passage 42 is provided to communicate with an exhaust hole 34*a* formed in the outer circumference of the head valve 34. Accordingly, the compressed air in the cylinder 31 is introduced to the main exhaust passage 42 through the exhaust hole 34*a* of the head valve 34, and is discharged to the outside. A main exhaust chamber (not illustrated) configured to reduce the pressure of the compressed air is provided on the main exhaust passage 42. The main exhaust chamber is formed by covering the side portion of the body housing 12 with a resin cover 22. A plurality of slits illustrated in FIG. 1 are provided on the surface of the resin cover 22, and the slit forms a discharge port 43*b* configured to discharge the compressed air of the main exhaust chamber to the outside.

The head valve chamber 46 is a space configured to store the compressed air for biasing the head valve 34 to a stand-by state. The head valve chamber 46 is configured to open and close to external air and the main chamber 41 by the pilot valve 40. That is, as illustrated in FIG. 3, in a state where the pilot valve 40 is not operated, the head valve chamber 46 communicates with the main chamber 41, and stores the compressed air supplied from the compressor and the like. At this time, the head valve chamber 46 is in the state of being closed to the external air.

On the other hand, as illustrated in FIG. 4, in a state where the pilot valve 40 is operated, the head valve chamber 46 is opened to the atmosphere, and thus the compressed air of the head valve chamber 46 is discharged. At this time, the head valve chamber 46 and the main chamber 41 are blocked by the seal structure (0 ring) provided in the pilot valve 40, and thus the compressed air of the main chamber 41 is not discharged.

The sub exhaust passage 47 is configured to discharge the compressed air of the head valve chamber 46 to the outside. The sub exhaust passage 47 is not connected to the above-described main exhaust passage 42, and is provided independently from the main exhaust passage 42.

The sub exhaust passage 47 includes a sub exhaust duct 48 connected to the head valve chamber 46, and a sub exhaust chamber 49 provided in the downstream of the sub exhaust duct 48. The sub exhaust duct 48 and the sub exhaust chamber 49 are openable and closable by the pilot valve 40.

Next, the seal structure of the head valve 34 according to this embodiment will be described with reference to FIGS. 6A to 8B.

Figure 6A:
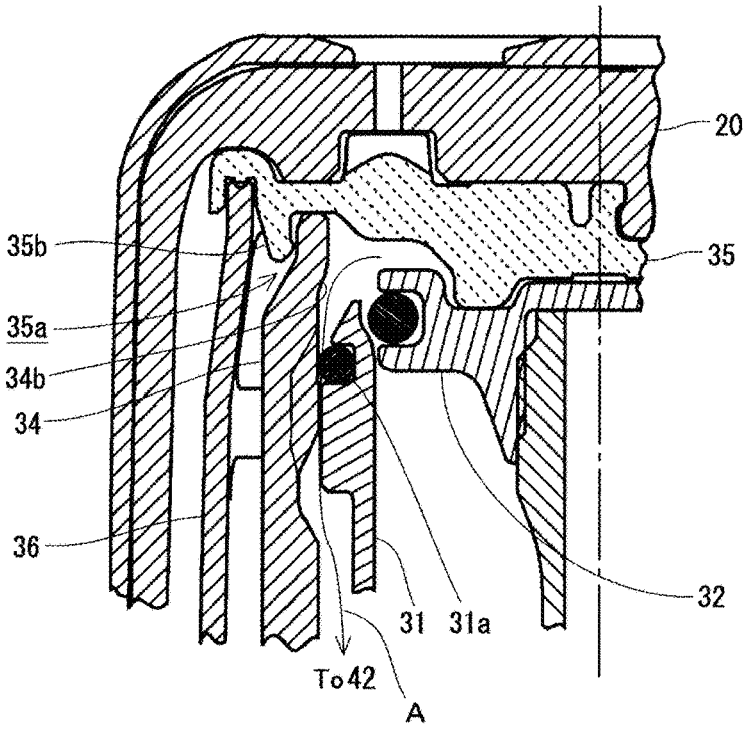
FIG. 6A is an enlarged sectional view illustrating a state where the head valve is not operated yet.
Figure 6B:
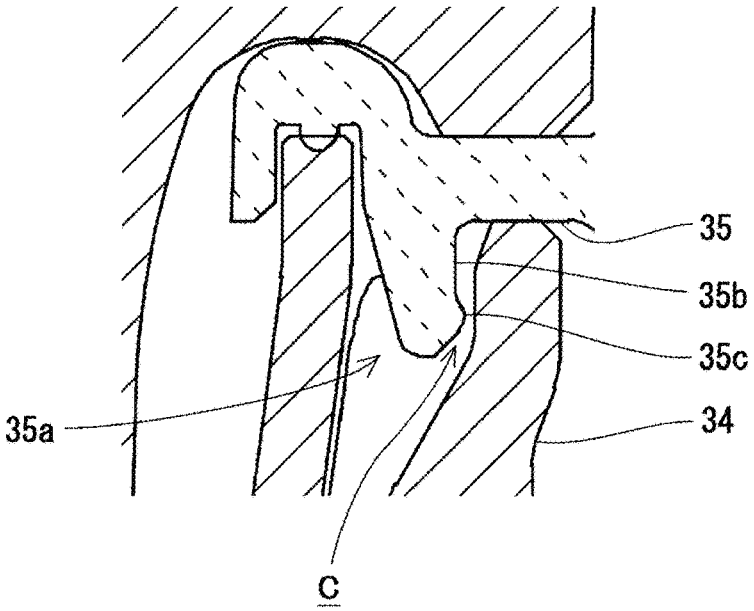
FIG. 6B is a further enlarged view of FIG. 6A.

As described above, the seal portion 35*a* is provided in the piston stop 35 to face the opening edge of the head valve 34. As illustrated in FIGS. 6A and 6B, the seal portion 35*a* includes a lip portion 35*b* protruding along the outer circumferential surface of the head valve 34. As illustrated in FIG. 6A, in a state where the head valve 34 is not operated yet, the lip portion 35*b* protrudes with a clearance C provided between the lip portion 35*b* and the outer circumferential surface of the head valve 34. A protrusion 35*c* protruding toward the outer circumferential surface of the head valve 34 is formed on the inner circumferential surface of the lip portion 35*b*.

Figure 7A:
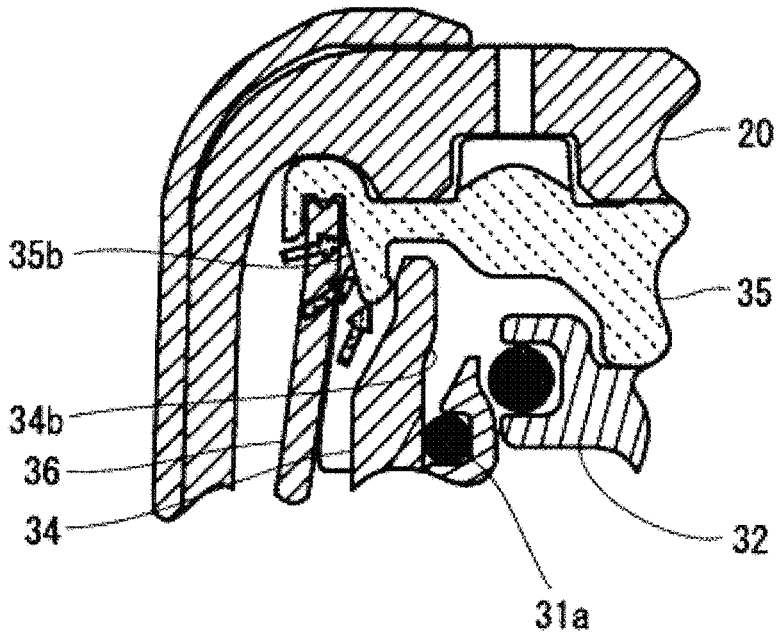
FIG. 7A is an enlarged sectional view illustrating a state where the head valve is being operated (Part 1)

As illustrated in FIG. 7A, when the head valve 34 is operated to be slid in a direction of being apart from the seal portion 35*a*, an air pressure difference is generated between the inside (cylinder 31 side) and the outside (main chamber 41 side) of the lip portion 35*b*. That is, since the air pressure inside the cylinder 31 is substantially the same as the atmosphere pressure and the main chamber 41 is filled with the compressed air, the air pressure on the outside of the lip portion 35*b* is higher than that on the inside. In this embodiment, the protrusion 35*c* is provided on the inner circumferential surface of the lip portion 35*b* such that the compressed air is controlled not to flow into the lip portion 35*b* at once.

Figure 7B:
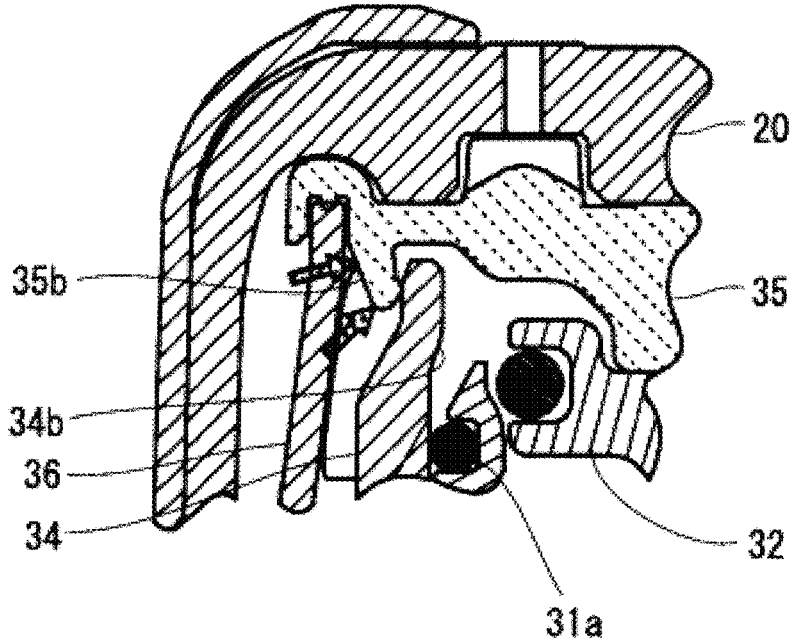
FIG. 7B is an enlarged sectional view illustrating a state where the head valve is being operated (Part 2)
Figure 8A:
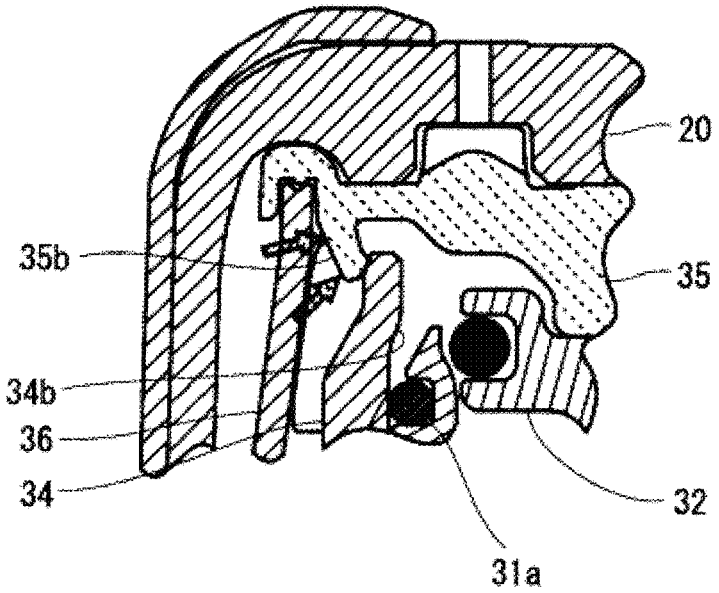
FIG. 8A is an enlarged sectional view illustrating a state where the head valve is being operated (Part 3)

As illustrated in FIG. 7B, when the air pressure difference is generated as described above, the lip portion 35*b* is pushed and bent inward by the pneumatic pressure. Accordingly, the lip portion 35*b* contacts with the outer circumferential surface of the head valve 34. Such a deformation of the lip portion 35*b* makes the above-described clearance C be filled up, and prevents the compressed air from flowing into the cylinder 31. As illustrated in FIG. 8A, the flow of the compressed air is prevented as long as the tip of the lip portion 35*b* and the opening edge of the head valve 34 are overlapped.

When the head valve 34 is slid so that the tip of the lip portion 35*b* and the opening edge of the head valve 34 are apart from each other, a supply passage of the compressed air into the cylinder 31 is completely opened, and thus the compressed air flows at a stroke to operate the piston 32.

The compressed air, which is used to operate the piston 32, in the cylinder 31 is discharged to the outside through the main exhaust passage 42 as described above. As indicated by an arrow A of FIG. 6A, the discharged air at this time flows to the main exhaust passage 42 through a passage between the cylinder 31 and the head valve 34. The passage to the main exhaust passage 42 is formed to be sealable by a seal member 31*a* mounted in the cylinder 31 and a receiving portion 34*b* provided in the head valve 34.

As illustrated in FIG. 6A and the like, the seal member 31*a* is an O-ring mounted to the outer circumference of the cylinder 31.

As illustrated in FIG. 6A and the like, the receiving portion 34*b* is provided to face the seal member 31*a*. The receiving portion 34*b* has a seal surface formed obliquely to a sliding direction of the head valve 34.

As illustrated in FIG. 6A, the seal member 31*a* does not contact the seal surface of the receiving portion 34*b* in a state where the head valve 34 is not operated, and thus the inside of the cylinder 31 communicates with the main exhaust passage 42. In this manner, in a state where the head valve 34 seals the supply passage into the cylinder 31, an exhaust passage of the compressed air into the cylinder 31 becomes in an opened state.

Figure 8B:
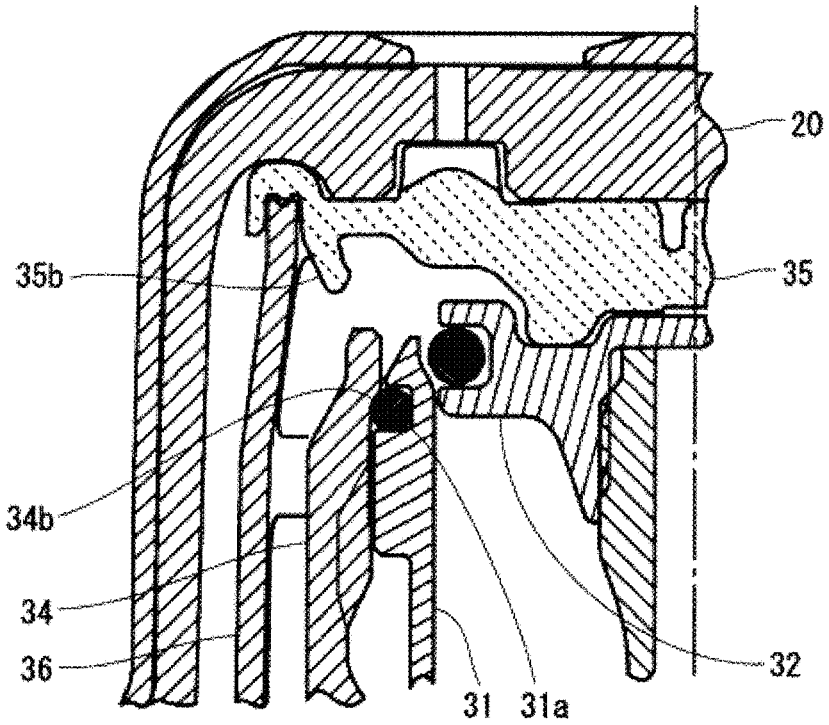
FIG. 8B is an enlarged sectional view illustrating a state where the head valve is operated.

On the other hand, as illustrated in FIG. 8B, in a state where the head valve 34 is operated, the seal member 31*a* contacts with the seal surface of the receiving portion 34*b*, and thus the inside of the cylinder 31 is blocked from the main exhaust passage 42. In this manner, in a state where the head valve 34 opens the supply passage into the cylinder 31, the exhaust passage of the compressed air into the cylinder 31 becomes in a sealed state.

As illustrated in FIGS. 7A, 7B, and 8A, from the time when the head valve 34 starts to operate to the time when the exhaust passage of the compressed air into the cylinder 31 is sealed, the head valve 34 is in the middle of a stroke. For this reason, a time difference is generated between the timing when the supply passage is opened into the cylinder 31 and the timing when the exhaust passage of the compressed air in the cylinder 31 is sealed. However, in this embodiment, the lip portion 35*b* is bent by the air pressure difference as described above so that the supply passage into the cylinder 31 is sealed during the stroke of the head valve 34, and thus the above-described difference of the timing becomes small.

As described above, according to this embodiment, the seal portion 35*a* is provided to face the opening edge of the head valve 34. The seal portion 35*a* includes the lip portion 35*b* protruding along the outer circumferential surface of the head valve 34, and the lip portion 35*b* protrudes with the clearance C provided between the lip portion 34 and the outer circumferential surface of the head valve 34. With such a configuration, the clearance C is provided in advance between the lip portion 35*b* and the outer circumferential surface of the head valve 34, and thus a slide resistance with the head valve 34 does not increase although there is a slight dimension change in the seal portion 35*a*. That is, the slide resistance does not increase although the dimension is not severely managed.

When the head valve 34 is slid in the direction of separating from the seal portion 35*a*, the air pressure difference is generated between the inside and the outside of the lip portion 35*b*, and thus the lip portion 35*b* is bent in a direction of contacting the outer circumferential surface of the head valve 34. That is, the lip portion 35*b* protrudes along the outer circumferential surface of the head valve 34, and thus in starting the movement of the head valve 34, the lip portion 35*b* is deformed by the air pressure difference, and contacts the head valve 34. For this reason, the lip portion 35*b* seals the supply passage although the clearance C is provided, and thus the timing when the supply passage is completely opened can be delayed. The time difference between the timing when the supply passage is opened and the timing when the exhaust passage is closed is shortened by delaying the timing when the supply passage is completely opened, and thus the leakage of the compressed air from the exhaust passage can be suppressed.

Even in a case where the sealing by the opening edge is incompletely performed, for example, a case where a foreign matter is attached to the opening edge of the head valve 34, the air leakage or an erroneous operation can be suppressed since an intake passage is sealed by the lip portion 35*b*.

In the above-described embodiment, the supply passage into the cylinder 31 is sealed by the deformation of the lip portion 35*b* during the stroke of the head valve 34. However, the invention is not limited thereto, the lip portion 35*b* may not contact the head valve 34 when the lip portion 35*b* is deformed, and the supply passage may not be sealed. Even in such a case, an effect of suppressing the air leakage can be obtained by shortening the gap through the deformation of the lip portion 35*b*. The lip portion 35*b* does not contact the head valve 34, and thus the increase of the slide resistance between both is suppressed so that the movement of the head valve 34 is smoothly performed. Accordingly, the time until the exhaust passage is sealed is shortened, and thus the leakage of the compressed air from the exhaust passage can be suppressed.

The seal member 31*a* is mounted in the cylinder 31, the receiving portion 34*b* facing the seal member 31*a* is provided in the head valve 34, the receiving portion 34*b* includes the seal surface formed obliquely to the sliding direction of the head valve 34, and the seal member 31*a* contacts the seal surface, thereby sealing the exhaust passage. According to such a configuration, until the seal member 31*a* contacts the receiving portion 34*b*, the seal member 31*a* does not almost contact another member. Therefore, it can be prevented that the seal member 31*a* increases the slide resistance of the head valve 34, and the head valve 34 can be smoothly slid. The head valve 34 is smoothly slid so that the time until the exhaust passage is sealed is shortened, and thus the time difference between the timing when the supply passage is opened and the timing when the exhaust passage is closed is shortened so that the leakage of the compressed air from the exhaust passage can be suppressed.

As illustrated in FIG. 6B and the like, the tapered surface is formed on the inner circumferential side of the tip of the lip portion 35*b* and the outer circumferential side of the opening edge of the head valve 34, and thus the operation can be smoothly performed while the lip portion 35*b* and the head valve 34 are not caught.

In the above-described embodiment, the seal member 31*a* is mounted in the cylinder 31, and the receiving portion 34*b* is provided in the head valve 34. However, the invention is not limited thereto, the seal member 31*a* may be mounted in the head valve 34, and the receiving portion 34*b* may be provided in the cylinder 31.

The invention claimed is:

1. A driving tool comprising:

a driver configured to drive out a fastener;

a piston to which the driver is connected;

a cylinder in which the piston is disposed so as to be reciprocated;

a head valve which is slidably mounted to an outer circumferential side of the cylinder and which controls a flow of compressed air into the cylinder; and a seal portion which faces an opening edge of the head valve, wherein the seal portion includes a lip portion located radially outside of the head valve and radially outside of the opening edge of the head valve, and wherein the lip portion protrudes along an outer circumferential surface on an outer side of the head valve, and further wherein the head valve has a stroke such that during opening the opening edge of the head valve passes beyond and becomes spaced from the lip portion.

2. The driving tool according to claim 1, wherein the lip portion protrudes with a clearance provided between the lip portion and the outer circumferential surface of the head valve.

3. The driving tool according to claim 2, wherein a tapered surface is formed on an inner circumferential side of a tip of the lip portion or an outer circumferential side of the head valve adjacent the opening edge.

4. The driving tool according to claim 3, wherein a seal member is mounted to any one of the head valve and the cylinder, a receiving portion facing the seal member is provided in the other one of the head valve and the cylinder, the receiving portion includes a seal surface formed obliquely to a sliding direction of the head valve, and an exhaust passage formed between the cylinder and the head valve is sealed by the seal member contacting with the seal surface.

5. The driving tool according to claim 2, wherein a seal member is mounted to any one of the head valve and the cylinder, a receiving portion facing the seal member is provided in the other one of the head valve and the cylinder, the receiving portion includes a seal surface formed obliquely to a sliding direction of the head valve, and an exhaust passage formed between the cylinder and the head valve is sealed by the seal member contacting with the seal surface.

6. The driving tool according to claim 1, wherein a tapered surface is formed on an inner circumferential side of a tip of the lip portion or an outer circumferential side of the head valve adjacent the opening edge.

7. The driving tool according to claim 6, wherein a seal member is mounted to any one of the head valve and the cylinder, a receiving portion facing the seal member is provided in the other one of the head valve and the cylinder, the receiving portion includes a seal surface formed obliquely to a sliding direction of the head valve, and an exhaust passage formed between the cylinder and the head valve is sealed by the seal member contacting with the seal surface.

8. The driving tool according to claim 1, wherein a seal member is mounted to any one of the head valve and the cylinder, a receiving portion facing the seal member is provided in the other one of the head valve and the cylinder, the receiving portion includes a seal surface formed obliquely to a sliding direction of the head valve, and an exhaust passage formed between the cylinder and the head valve is sealed by the seal member contacting with the seal surface.

9. The driving tool according to claim 1, further including a cylindrical guide located radially outside of the head valve and which supports the seal portion at a location radially outside of the lip portion.

10. A driving tool comprising:

a driver configured to drive out a fastener;

a piston to which the driver is connected;

a cylinder in which the piston is disposed so as to be reciprocated;

a head valve which is slidably mounted to an outer circumferential side of the cylinder and which controls a flow of compressed air into the cylinder; and a seal portion which faces an opening edge of the head valve, wherein the seal portion includes a lip portion located radially outside of the head valve and radially outside of the opening edge of the head valve, and wherein the lip portion protrudes along an outer circumferential surface on an outer side of the head valve, wherein the lip portion protrudes with a clearance provided between the lip portion and the outer circumferential surface of the head valve, and wherein when the head valve slides in a direction away from the seal portion, an air pressure difference is generated between an inside and an outside of the lip portion, and the lip portion is bent radially inwardly to contact the outer circumferential surface of the head valve.

11. The driving tool according to claim 10, wherein a tapered surface is formed on an inner circumferential side of a tip of the lip portion or an outer circumferential side of the head valve adjacent the opening edge.

12. The driving tool according to claim 11, wherein a seal member is mounted to any one of the head valve and the cylinder, a receiving portion facing the seal member is provided in the other one of the head valve and the cylinder, the receiving portion includes a seal surface formed obliquely to a sliding direction of the head valve, and an exhaust passage formed between the cylinder and the head valve is sealed by the seal member contacting with the seal surface.

13. The driving tool according to claim 10, wherein a seal member is mounted to any one of the head valve and the cylinder, a receiving portion facing the seal member is provided in the other one of the head valve and the cylinder, the receiving portion includes a seal surface formed obliquely to a sliding direction of the head valve, and an exhaust passage formed between the cylinder and the head valve is sealed by the seal member contacting with the seal surface.

14. A driving tool comprising:

a driver configured to drive out a fastener;

a piston to which the driver is connected;

a cylinder in which the piston is disposed so as to be reciprocated;

a head valve which is slidably mounted to an outer circumferential side of the cylinder and which controls a flow of compressed air into the cylinder; and a seal portion which faces an opening edge of the head valve, wherein the seal portion includes a lip portion located radially outside of the head valve and radially outside of the opening edge of the head valve, and wherein the lip portion protrudes along an outer circumferential surface on an outer side of the head valve, wherein in a fully closed position, a top of the opening edge of the head valve contacts the seal portion at a location radially inside of the lip portion, wherein during opening, the head valve slides away from the seal portion to a first position in which the top of the opening edge is spaced from the seal portion at said location radially inside of the lip portion, and in the first position the lip portion contacts the outer circumferential surface of the head valve, and wherein during continued movement of the head valve from the first position in a direction away from the seal portion the lip portion passes the opening edge of the head valve and a second position is reached, and wherein in said second position both said lip portion and the seal portion at the location radially inside of the lip portion are spaced from the head valve.

15. The driving tool according to claim 14, wherein during movement of the head valve from the fully closed position to the first position, air pressure bends the lip portion radially inwardly into contact with the outer circumferential surface of the head valve.

16. The driving tool according to claim 15, further including a cylindrical guide located radially outside of the head valve and which supports the seal portion at a location radially outside of the lip portion.

* * * * *